US007557510B2

(12) United States Patent
Ghilardi

(10) Patent No.: US 7,557,510 B2
(45) Date of Patent: Jul. 7, 2009

(54) BRIDGE PARTICULARLY FOR CROSSING A PASSAGE OF A NAVIGATION CHANNEL

(75) Inventor: Jean-Pierre Ghilardi, Montlignon (FR)

(73) Assignee: Societe Europeenne d'Ingenierie Mecanique-Eurodim, Rueil Malmaison Cedex (FR)

( * ) Notice: Subject to any disclaimer, the term of this patent is extended or adjusted under 35 U.S.C. 154(b) by 0 days.

(21) Appl. No.: 10/571,931

(22) PCT Filed: Sep. 1, 2004

(86) PCT No.: PCT/FR2004/002223

§ 371 (c)(1),
(2), (4) Date: Nov. 10, 2006

(87) PCT Pub. No.: WO2005/033411

PCT Pub. Date: Apr. 14, 2005

(65) Prior Publication Data

US 2008/0022468 A1 Jan. 31, 2008

(30) Foreign Application Priority Data

Sep. 22, 2003 (FR) ..... 03 11099

(51) Int. Cl.
*E01D 15/02* (2006.01)

(52) U.S. Cl. ..... 314/31; 14/36; 14/42

(58) Field of Classification Search ..... 14/31, 14/32, 36, 37, 39, 42, 43, 53, 68
See application file for complete search history.

(56) References Cited

U.S. PATENT DOCUMENTS

| | | | | | |
|---|---|---|---|---|---|
| 887,131 | A | * | 5/1908 | Shoemaker | 14/36 |
| 952,486 | A | * | 3/1910 | Waddell et al. | 14/42 |
| 1,027,477 | A | * | 5/1912 | Harrington | 14/42 |
| 1,038,226 | A | * | 9/1912 | Strauss | 14/42 |
| 1,093,202 | A | * | 4/1914 | Paine | 14/42 |
| 1,140,316 | A | * | 5/1915 | Rall | 14/42 |

(Continued)

FOREIGN PATENT DOCUMENTS

DE 12 16 913 5/1966

(Continued)

OTHER PUBLICATIONS

Website (2003), http://www.eriecanal.org/UnionCollege/The_Bridge2.html, the plan of Abram Swartz for the lift bridge over Pratt's slip, Lower Black Rock.*

(Continued)

*Primary Examiner*—Raymond W Addie
(74) *Attorney, Agent, or Firm*—Leydig, Voit & Mayer, Ltd.

(57) ABSTRACT

A bridge for crossing a passage of a navigation channel includes a section in the form of a single span, which may be displaced by vertical translation between a base position spanning the passage, in which the span rests on fixed support sections of the bridge, and a raised position, for opening the passage, and a support structure for the span on displacement of the span, and a drive for lifting the span. The bridge has only one support structure, with the drive, located on one side of the passage to be spanned.

19 Claims, 16 Drawing Sheets

U.S. PATENT DOCUMENTS

| | | | | | |
|---|---|---|---|---|---|
| 1,157,450 | A | * | 10/1915 | Strauss | 14/42 |
| 1,210,715 | A | * | 1/1917 | Shoemaker | 14/42 |
| 1,269,976 | A | * | 6/1918 | Strauss | 14/42 |
| 1,422,717 | A | * | 7/1922 | Joosting | 14/42 |
| 1,565,571 | A | * | 12/1925 | Howard et al. | 14/42 |
| 1,597,298 | A | * | 8/1926 | Strauss | 14/42 |
| 1,680,821 | A | * | 8/1928 | Strauss | 14/36 |
| 1,731,697 | A | * | 10/1929 | Allen et al. | 14/36 |
| 1,765,407 | A | * | 6/1930 | Dodge | 14/42 |
| 1,991,336 | A | * | 2/1935 | Six | 14/42 |
| 2,040,445 | A | * | 5/1936 | Sakamoto | 14/42 |
| 2,047,601 | A | * | 7/1936 | Strauss | 14/42 |
| 2,057,028 | A | * | 10/1936 | Howard et al. | 14/42 |
| 2,103,661 | A | * | 12/1937 | Brown, Jr. | 14/42 |
| 2,482,562 | A | * | 9/1949 | Shoemaker | 14/42 |
| 3,394,420 | A | * | 7/1968 | Popov | 14/42 |
| 3,740,782 | A | * | 6/1973 | Newman | 14/42 |
| 3,908,217 | A | * | 9/1975 | Lapeyre | 14/42 |
| 4,535,498 | A | * | 8/1985 | Webster | 14/18 |
| 5,044,829 | A | * | 9/1991 | Hemminger | 405/203 |

FOREIGN PATENT DOCUMENTS

| | | |
|---|---|---|
| JP | 2002-115209 | 4/2002 |

OTHER PUBLICATIONS

Website of Gustave Flaubert Bridge from Rouen, France, http://www.abelard.org/france/pont_gustave_flaubert_rouen.php. Construction work started in Jun. 2004.*

* cited by examiner

BRIDGE PARTICULARLY FOR CROSSING A PASSAGE OF A NAVIGATION CHANNEL

FIELD OF INVENTION

The invention relates to a bridge intended in particular for crossing a channel of a waterway and having a part in the form of a span, which can be moved by vertical translation between a low position for crossing the channel, in which the span rests on stationary support parts of the bridge, and a high position for opening the channel, and a support structure for the span during its movement as well as some means for lifting the span.

BACKGROUND

Bridges of this type that are known have the major disadvantage of having a complex structure requiring much space, inasmuch as they have, on each side of the channel, a support structure that requires extensive installation work particularly when the structure is in the water, and that must be equipped with lifting means that must be powered and perfectly coordinated, which requires sophistication in the design of these means.

SUMMARY OF THE INVENTION

The present invention provides a bridge that does not have the disadvantages just set forth.

To attain this aim, a bridge according to the invention has only one support structure, provided with lifting means, which is arranged on just one side of the channel to be crossed.

According to one characteristic of the invention, the lifting means entails a traction cable, one end of which is attached to the span and the other end of which is connected to a traction device, running over pulleys that are part of the support structure.

According to another characteristic of the invention, the two lifting cables are attached to each side of the span and run over a pulley mounted on the support structure in a vertical plane passing through the middle of the span.

According to yet another characteristic of the invention, the support structure has two girder support pylons each provided at its free end with a pulley over which cables for lifting the span run.

According to yet another characteristic of the invention, the pylons and the girders are provided with reinforcement elements such as girders or stay cables.

According to yet another characteristic of the invention, the means for lifting the span entail a balance arm mounted to pivot on a support structure from one end of which the span is suspended, whereas some pivoting actuation means are connected at the other end.

According to yet another characteristic of the invention, the span is a self-supporting structure suspended from the end of the balance arm by suspension cables.

According to yet another characteristic of the invention, the span has a lightened structure, borne by a multiple of stay cables, in a low position for crossing the channel as well as in a high position for opening the channel, the stay cables being suspended from end of the balance arm.

According to yet another characteristic of the invention, a balance arm includes two levers with two arms that are both mounted to pivot on a pylon while being connected, if necessary, by a crosspiece.

According to yet another characteristic of the invention, the weight of the span is at least partially counterbalanced by counterweights.

BRIEF DESCRIPTION OF DRAWING FIGURES

The invention will be better understood, and other aims, characteristics, details and advantages of it will appear more clearly in the course of the following explanatory description in reference to the appended drawings given only as examples illustrating two embodiments of the invention and in which.

DETAILED DESCRIPTION

Figure 1:
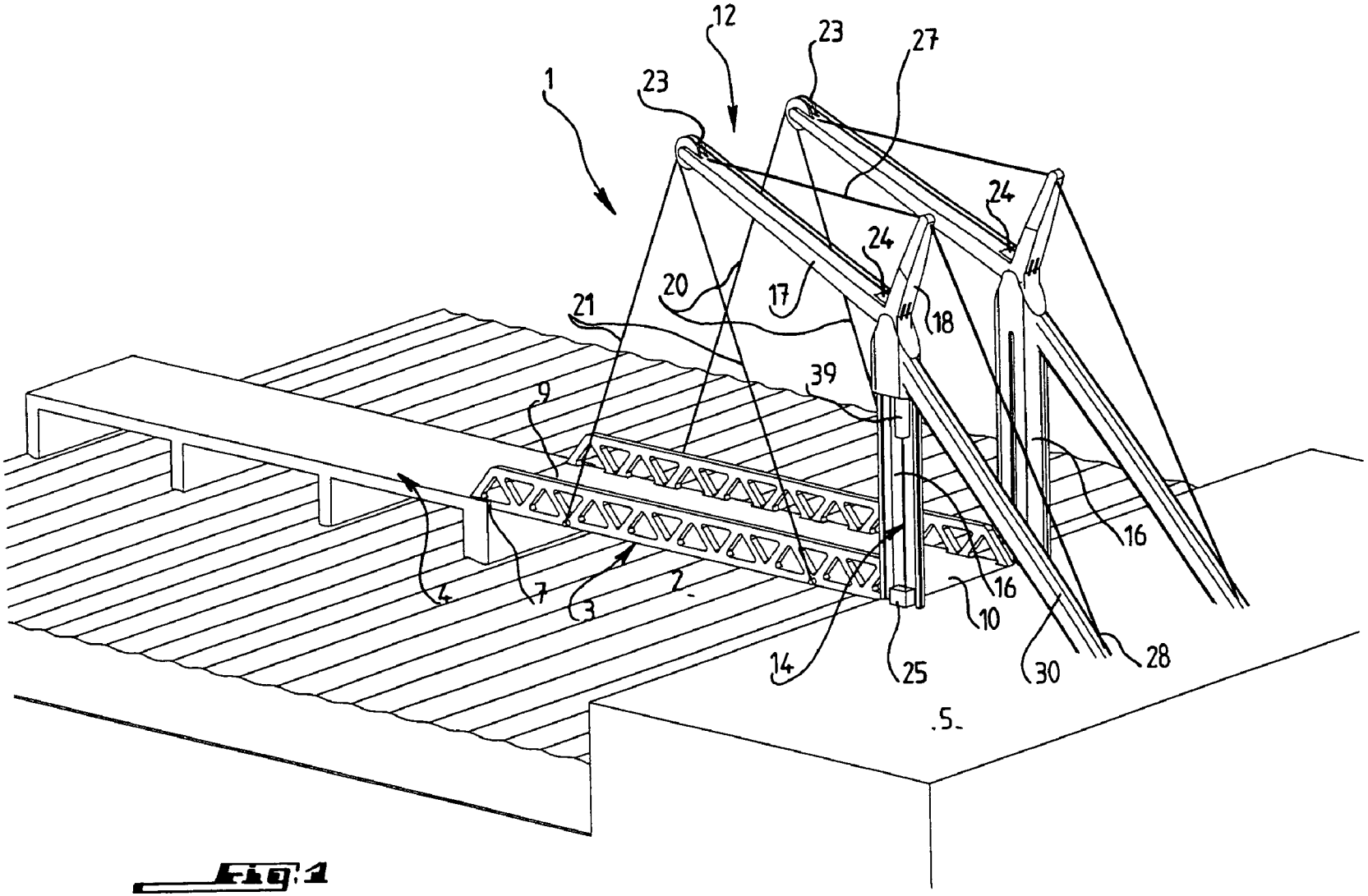
FIGS. 1 and 2 are perspective views of a first embodiment of a bridge according to the invention, the bridge occupying its low position for crossing the channel of a waterway.
Figure 2:
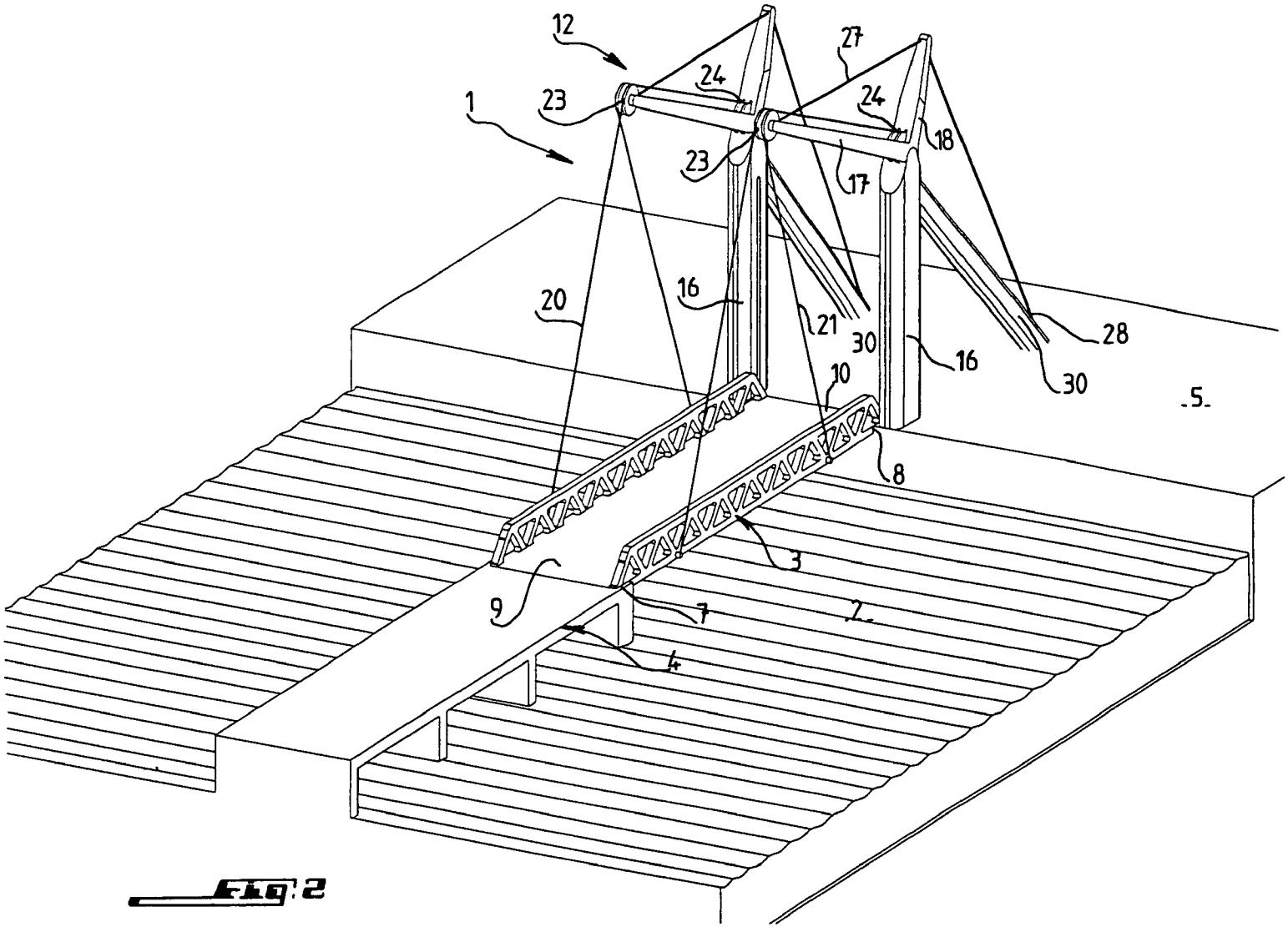
Figure 3:
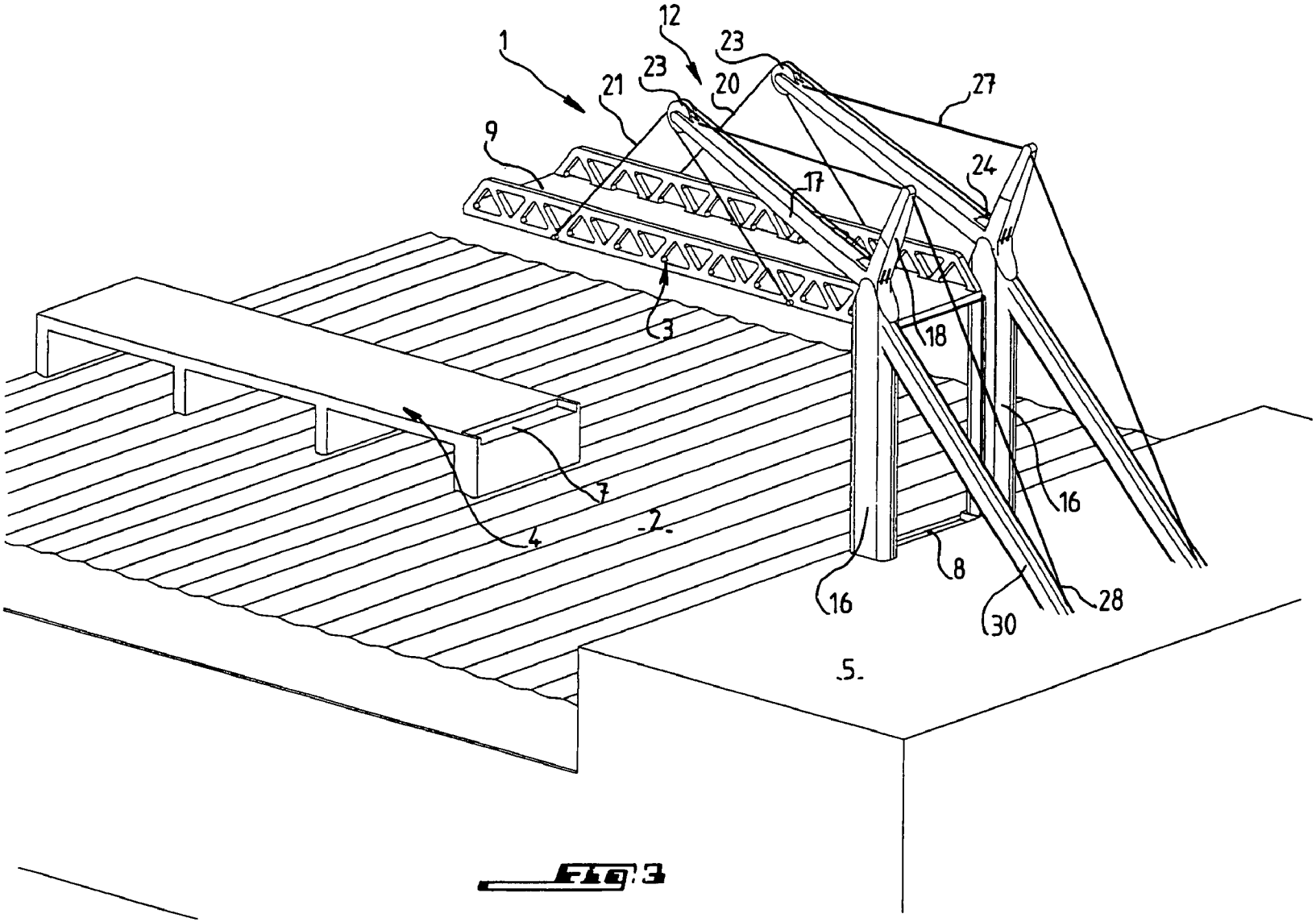
FIGS. 3 and 4 are perspective views of the embodiment according to FIGS. 1 and 2 but show this bridge in its high position for opening the channel.
Figure 4:
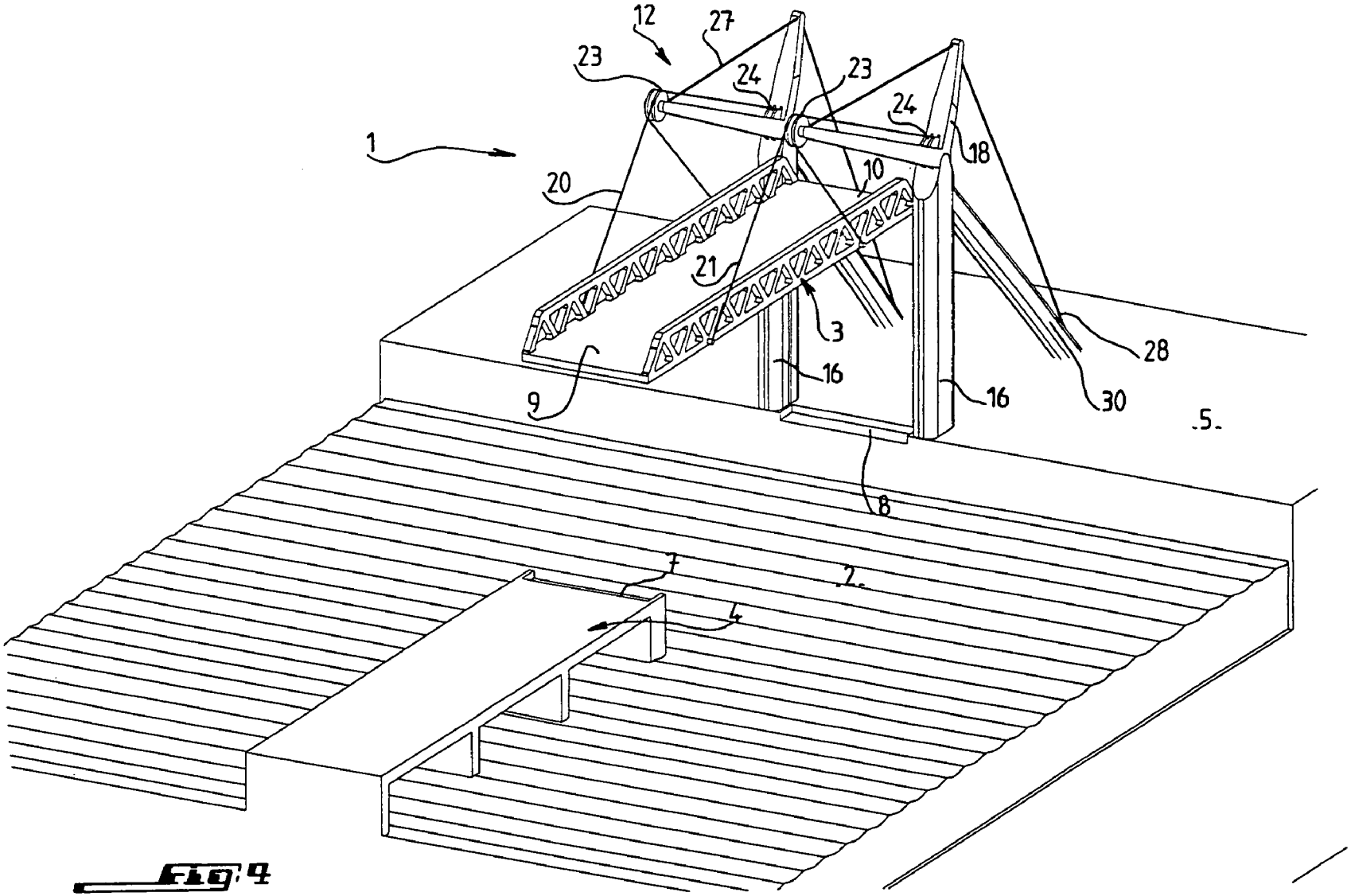
Figure 5:
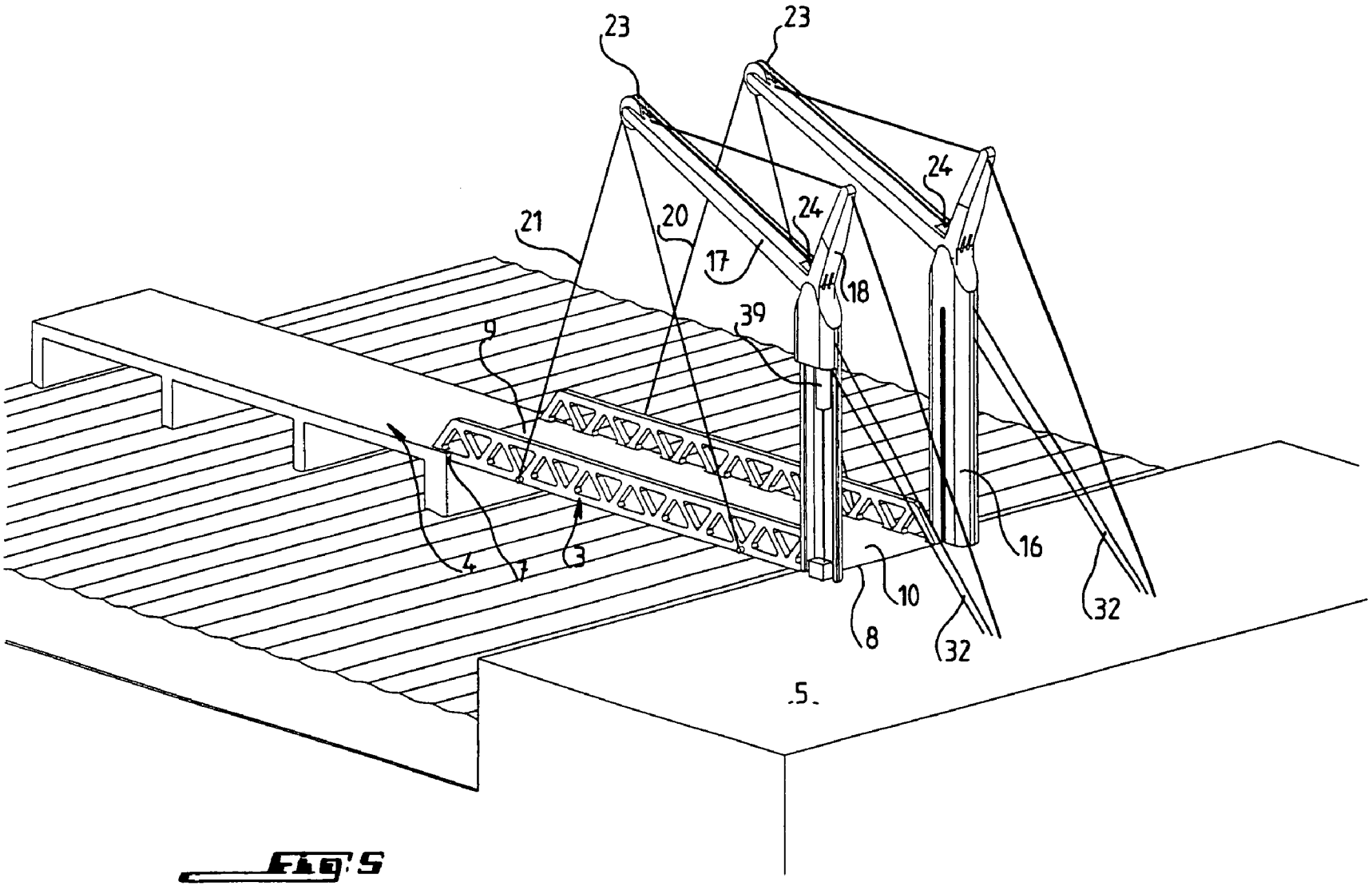
FIGS. 5 and 6 are perspective views of two different versions of the bridge according to FIGS. 1-4.

As illustrated by the figures, a lifting bridge 1 according to the invention, intended for enabling one to cross channel 2 of a maritime waterway, has a roughly horizontal mobile part in the form of span 3, which can be moved by translation roughly vertically between a low position for crossing channel 2 and a high position for opening the channel, and stationary parts 4, 5 on both sides of span 3 and on which the latter is supported at 7 and 8 by its two ends 9 and 10 in position for crossing. The bridge also has structure 12 for support of span 3 during its movement between its two positions for crossing the channel and for opening the channel, and some means 14 controlling the movement of the span, hereafter called lifting means.

As seen in the figures, lifting bridge 1 according to the invention has just one support structure 12 and just one lifting control device 14, which are mounted on just one side of channel 2 to be crossed, namely, in the example represented, on stationary part 5. This stationary support part, in the examples represented, is on one of the banks of the waterway but could also be provided in the waterway.

According to a first embodiment represented in FIGS. 1-6, support structure 12 is stationary and essentially includes, on each lateral side of span 3, vertical pylon 16 anchored at its lower end in stationary bank part 5 and which bears, at its upper end, girder 17 extending from the pylon, inclined upward, up to approximately the middle of span 2, and girder 18 extending upward at approximately a right angle with respect to girder 17.

Span 3 is suspended mainly during lifting from the free end of each girder 17 by the intermediary of two lifting cables 20, 21 fastened through an end of span 3 and running over pulley 23 mounted on the end of girder 17, along this girder, over another pulley 24 situated at the top of the pylon, and then inside of pylon 16 to traction device 25 arranged at the foot of this pylon. This device could be a winch for winding or unwinding of lifting cables 20, 21, or any other suitable traction device such as a jack. In order to ensure the horizontal position of span 3, each lifting cable 20, 21 is attached to span 3 at one end of the span.

Figure 6:
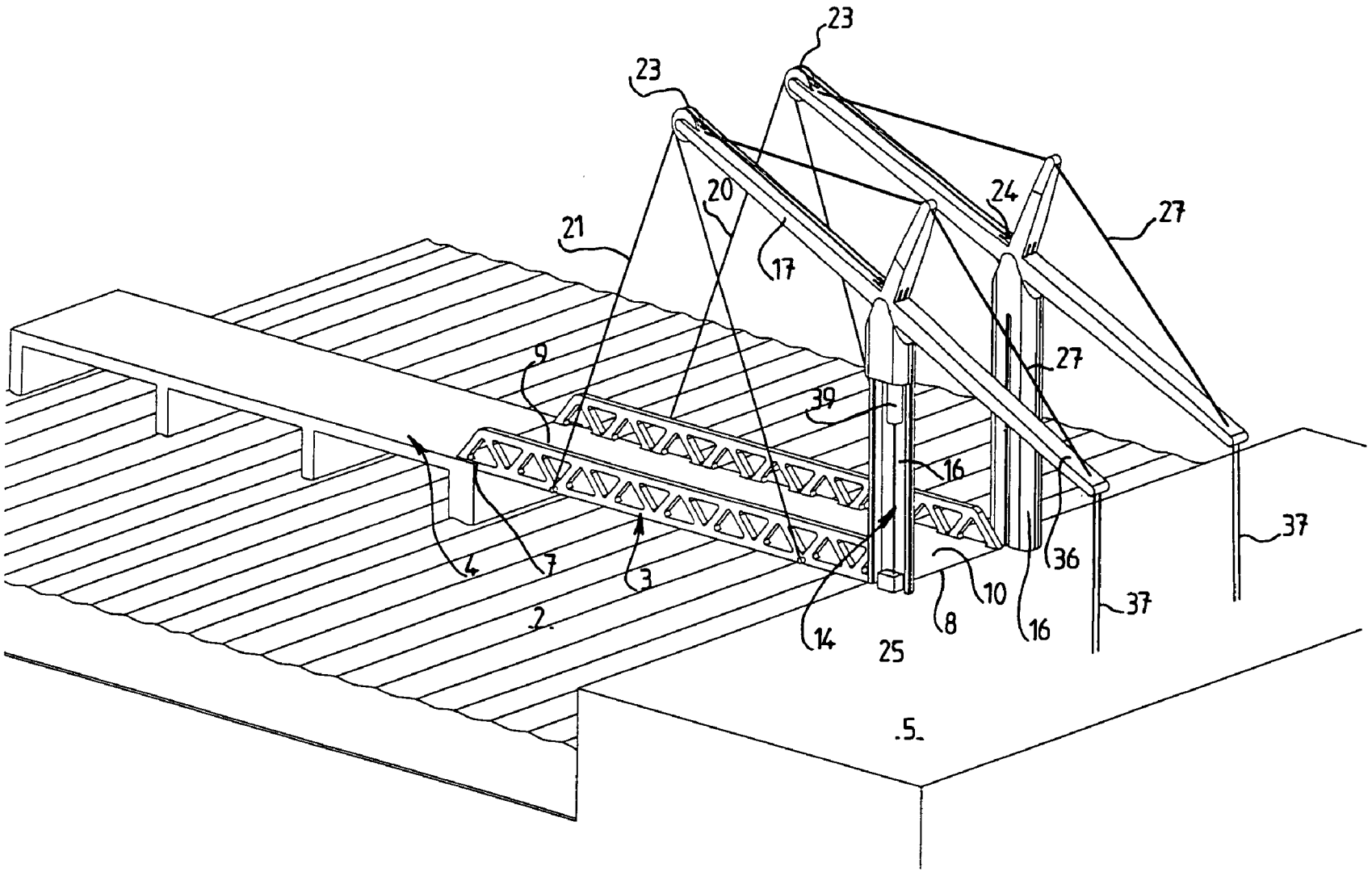
Figure 7:
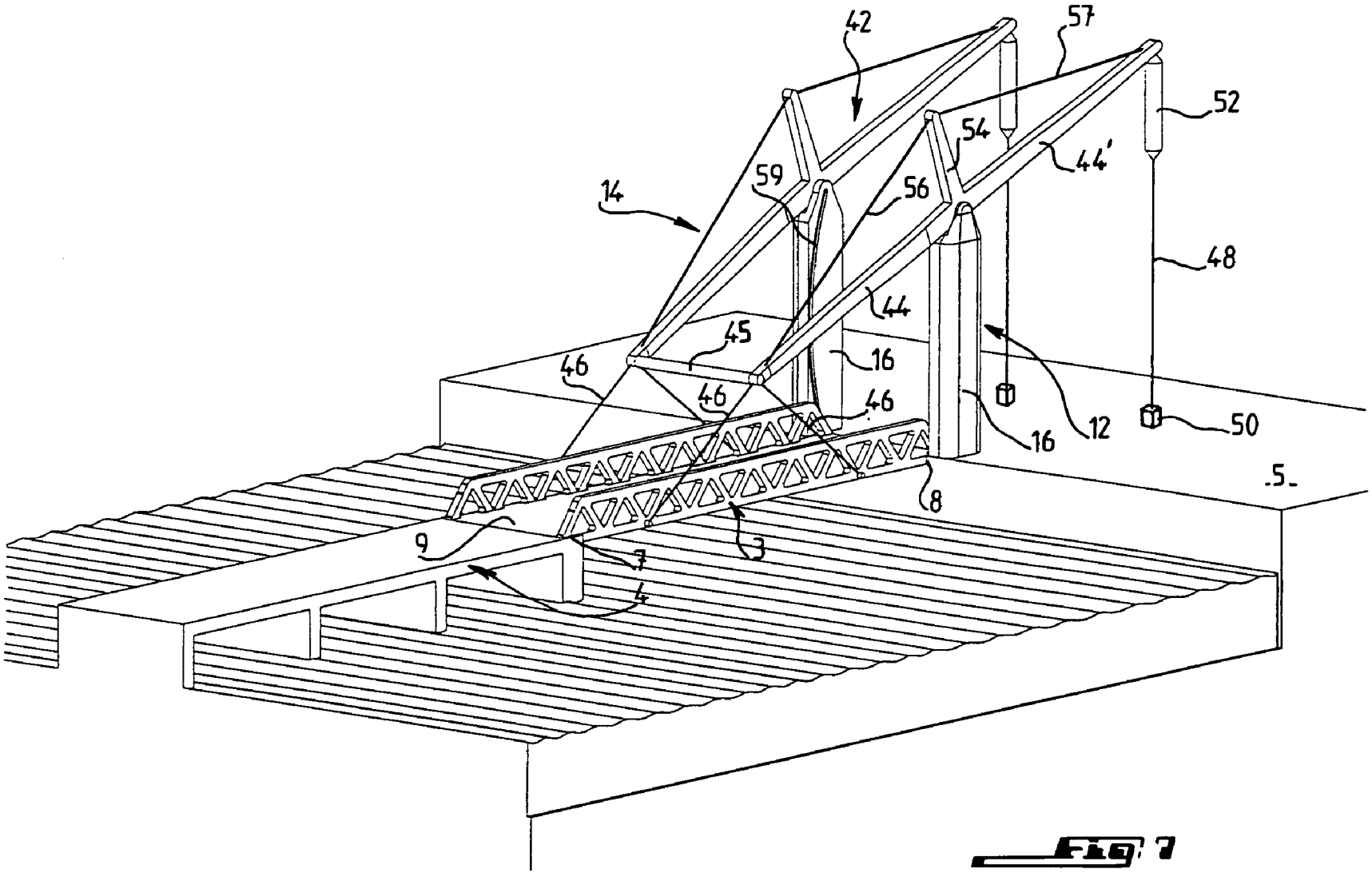
FIGS. 7 and 8 are perspective views illustrating a second embodiment of a bridge according to the invention in its position for crossing the channel.
Figure 8:
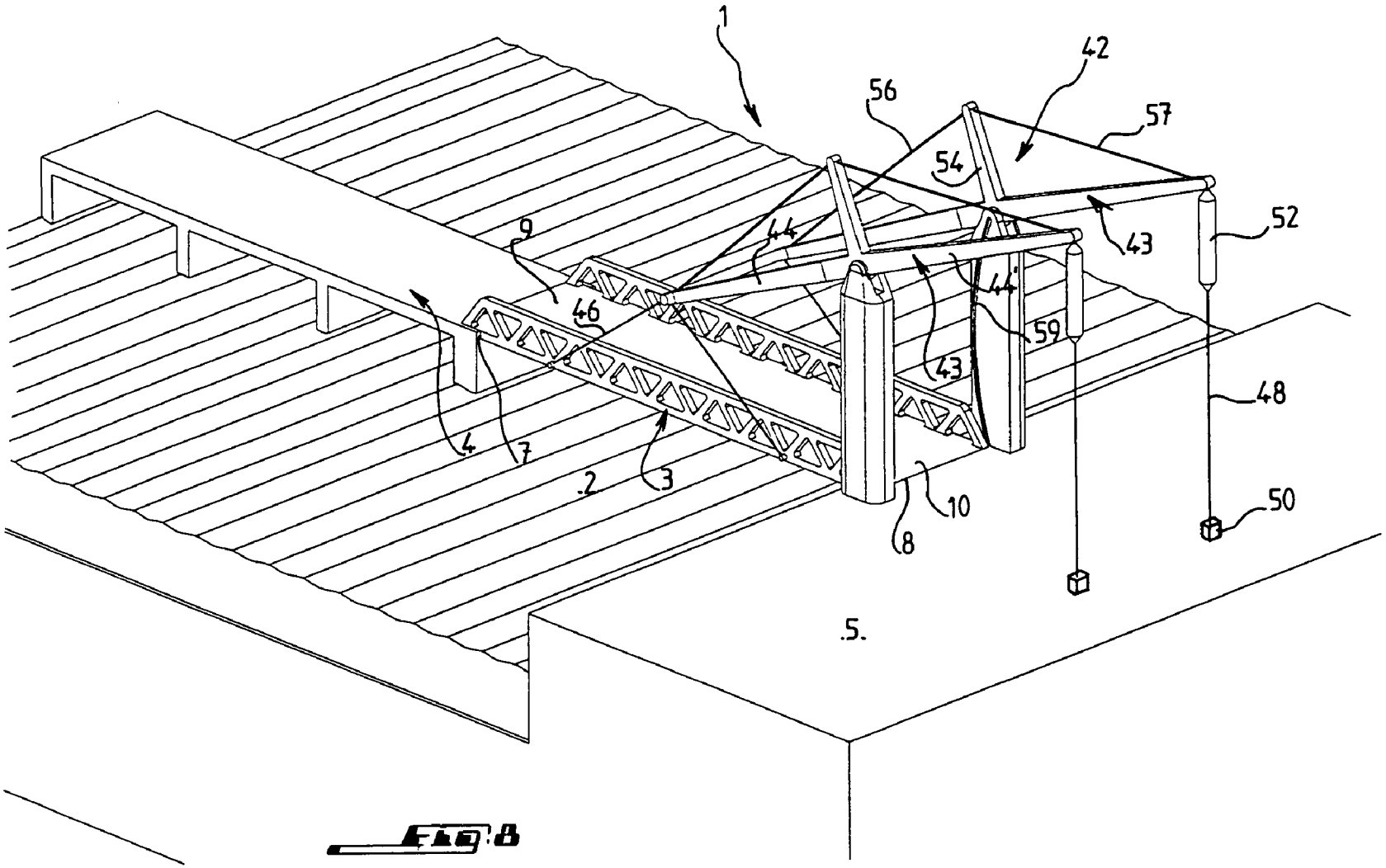

Given that the span is thus suspended from the free ends of girders 17, the end of each girder is held by stay cable 27 that extends between this end and the free end of holding girder 18, on one hand, and between these ends and stationary part 5 of the bridge on which it is attached at 28 an appropriate distance from the foot of pylon 16 in the plane formed by this pylon and suspension girder 17 and holding girder 18. In order to reinforce the support structure of the span, the upper end of each pylon 16 is held in position by reinforcing leg 30 that extends between the upper end of the pylon and the stationary part in the above-mentioned plane, as seen in FIGS. 1-4, or by two stay cables 32 according to FIG. 5. FIG. 6 shows yet another version of the device for reinforcing the support structure, which, in the extension of the suspension girder 17, beyond pylon 16, has girder part 36 whose end is held to stationary part 5 by stay cables 37 and which also serves as anchoring place for stay cable 27 for holding the free end of suspension girder 17. Of course, girders could also be used in place of stay cables 27 and 37.

It is observed that support structure 12 can possibly consist of framing members situated on the side of span 3, which are independent or connected by any type of connection. In general, any geometry can be applied to this structure.

The weight of span 3 suspended from support structure 12 can be1 to varying degrees balanced by counterweights acting continually or only during lifting. These counterweights, such as those indicated at 39, for example, are placed in the traction cables and, like these cables, are thus inside the pylons. Of course, any other suitable solution for the counterweights and traction cables can be considered. The counterweights could in particular be "disengaged" and the cables relaxed when the span is in position for crossing the channel.

Span 3 can be a self-supporting structure of the lattice, box, Warren girder or Bow string type or the like.

It should also be noted that the span, during its movement, is held at its corresponding end in contact with pylons 16 and is thus guided at just one end.

FIGS. 7-15 illustrate several versions of a second embodiment of a bridge according to the invention.

This second embodiment is characterized by the fact that the lifting of span 3 is ensured by the tilting of balance arm 42 mounted so as to pivot at the top of pylons 16. The pivoting of the balance arm takes place on rotational bearings, pivot pins, hard bearing or any other tilting mechanism. This balance arm is formed by two two-armed levers 43 connected together, for example, by crosspiece 45 at the ends of front arms 44, from which span 3 is suspended by suspension cables 46, whereas at each free end of rear arm 44', whose length can be different from that of the front arm, traction cables 48 are connected, actuated by a traction device of any appropriate nature such as winches or jacks 50. This traction device can be associated with a device for anchoring of the balance arm in stationary part 5, such as cables, bars, or portals, which immobilizes the tilting of the balance arm when the span is in position for crossing the channel and which does not hinder the action of the traction device during lifting. In order to counterbalance the weight of the span at least partially, counterweight 52 can be inserted between the end of the edge of lever 44' and each cable 48. Each two-armed lever 43 has, at the site of the tip of support pylon 16, transverse girder 54 that projects upward and makes it possible to prevent bending of the lever due to stay cables 56 and 57 attached between the end of girder 54 and the ends of suspension arm 44 and traction arm 44' of levers 43.

Given that during its movement under the effect of the tilting of balance arm 42, between its two positions for crossing channel 2 and for opening the channel, the span describes a slight arc of circle in the vertical plane, each pylon 16 has guide path 59 consequently curved on which the adjacent end of span 3 rests. A device for horizontal movement of the mechanism for pivoting the balance arm during lifting could enable one to avoid the curvature of this guide path.

Figure 10:
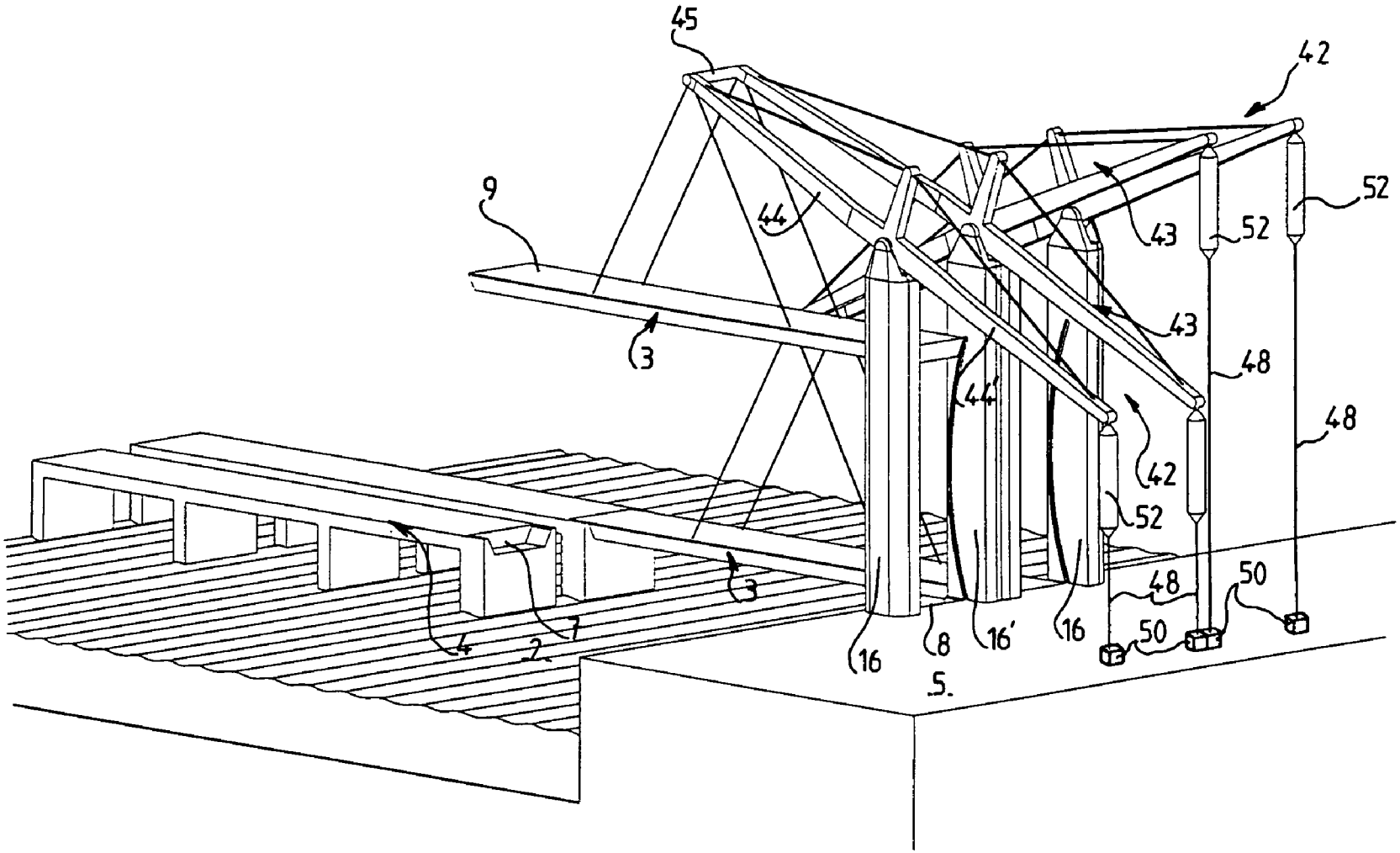
FIG. 10 is a perspective view of a bridge with two spans according to FIGS. 7-9
Figure 11:
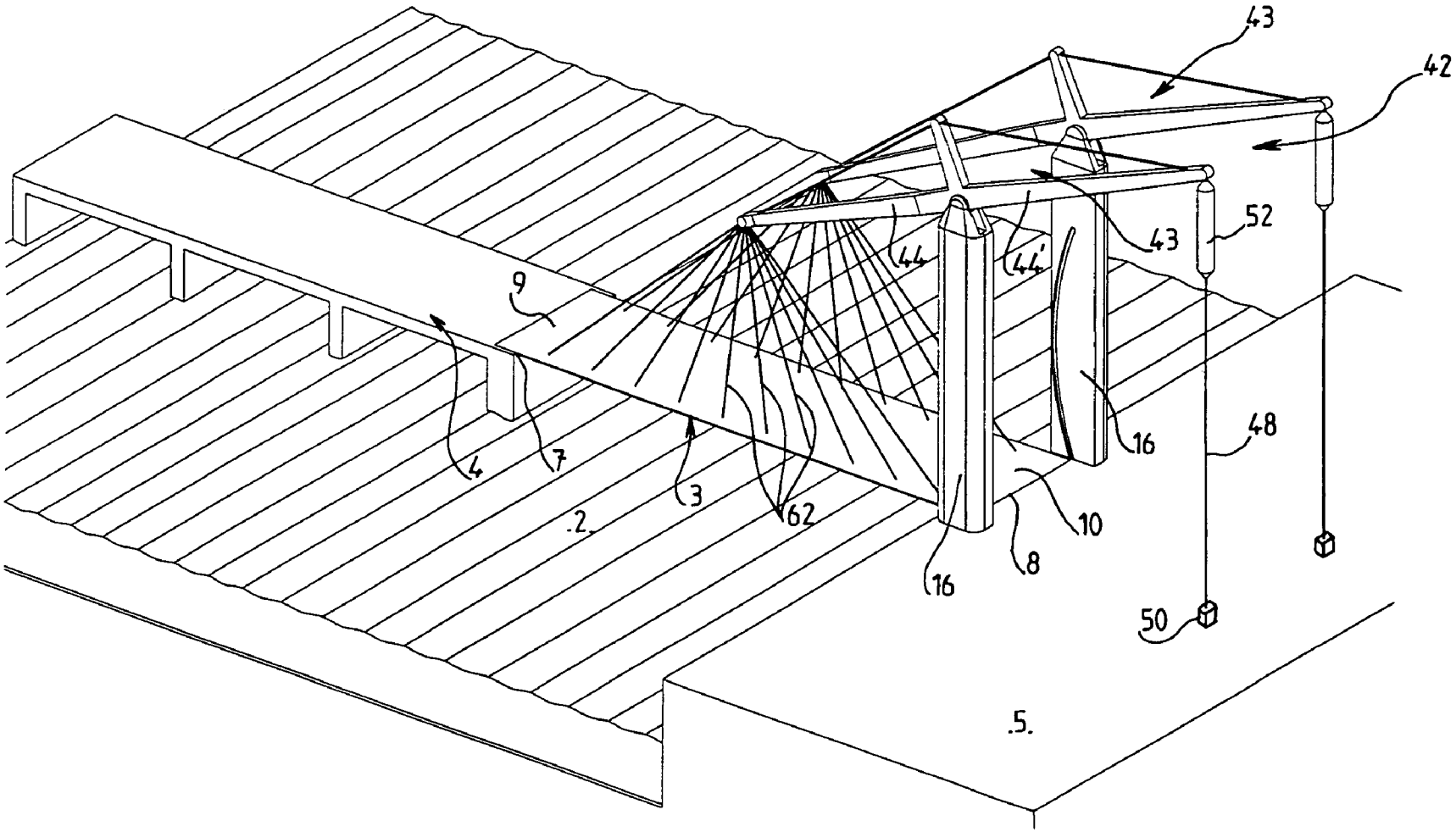
FIGS. 11 and 12 are perspective views of another version of the second embodiment of a bridge according to the invention, illustrating the bridge in its position for crossing the channel.
Figure 12:
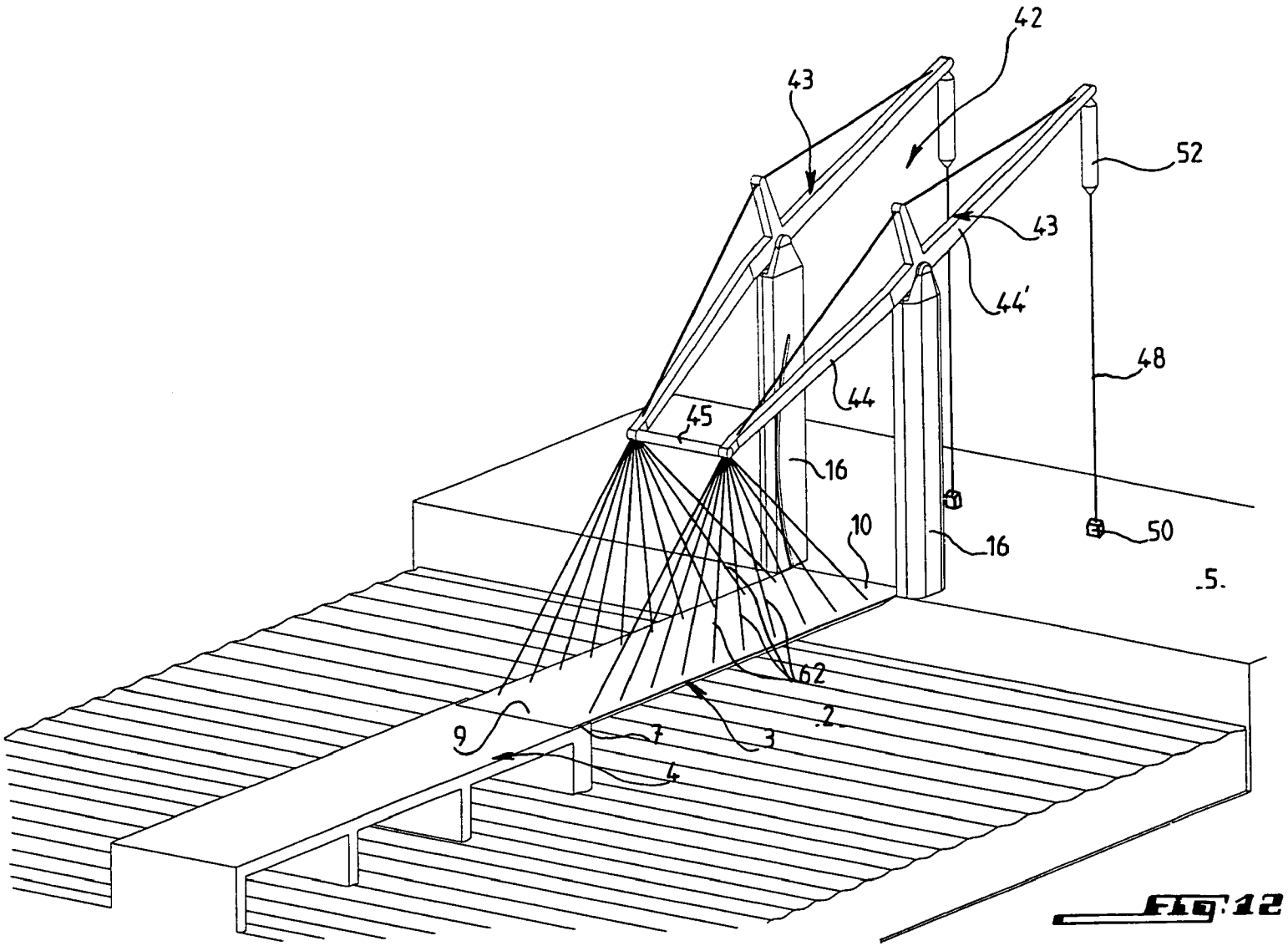
Figure 13:
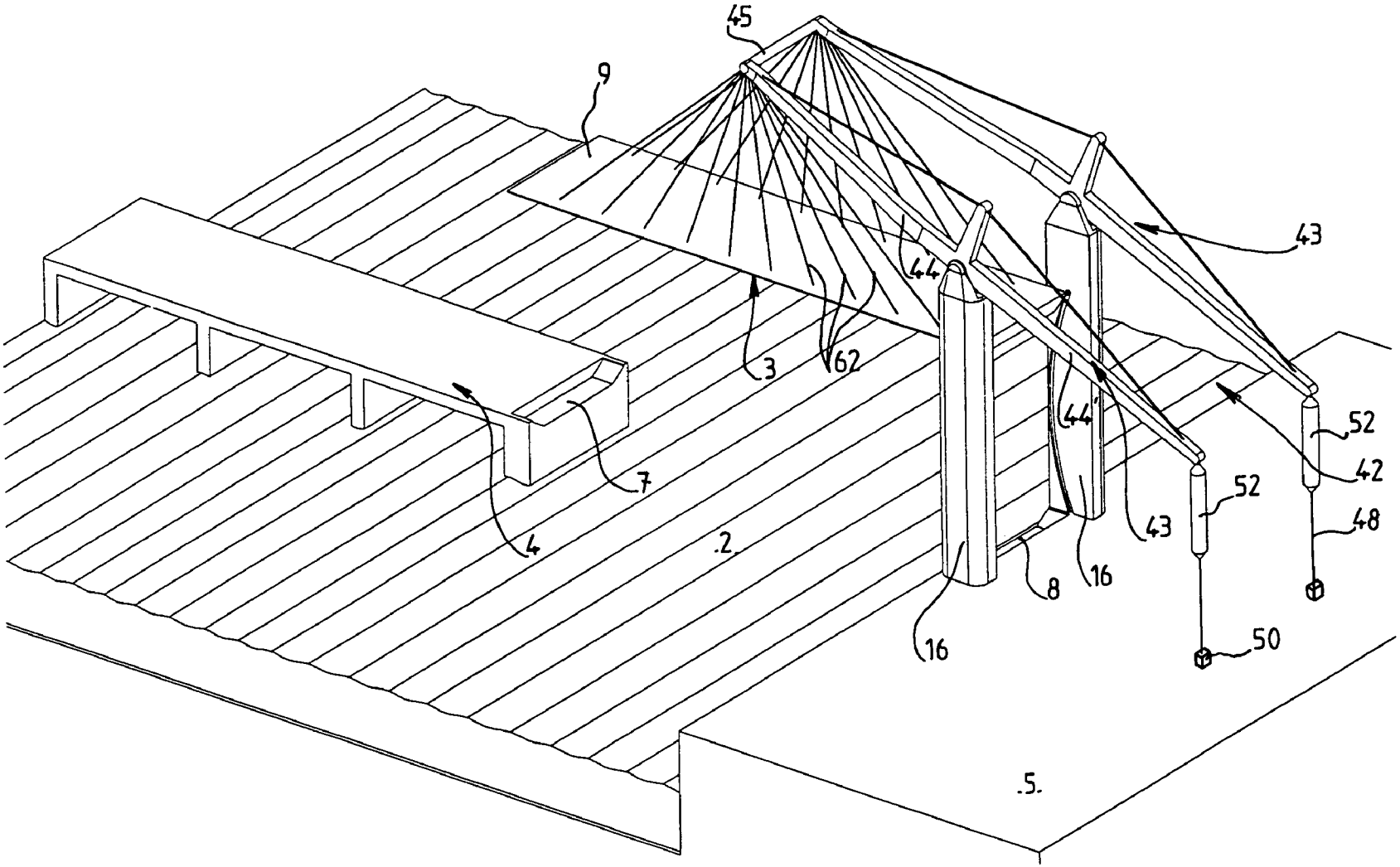
FIG. 13 is a perspective view of the bridge according to FIGS. 11 and 12 but illustrating the bridge in its high position for opening the channel.

FIG. 10 shows a bridge structure that has two separate and independently lifted spans 3, 3'. Each span is suspended from balance arm 42 as described in the preceding. The two balance arms could be mounted on two pairs of pylons 16 or on a device with three pylons of which the central pylon indicated by 16' in FIG. 10 would then be shared by the two balance arms.

In reference to FIGS. 11-15, a particularly advantageous implementation version of the embodiment of the bridge, with lifting of the spans by tilting of a balance arm, will be described hereafter. In this implementation version, span 3 is a cable-stayed structure, that is to say borne by multiple stay cables 62 in position of operation, that is to say in its position for crossing represented in FIGS. 11 and 12, as well as in lifting position according to FIG. 13, which allows simplification of the structure of the span, and particularly lightening of the weight, as emerges from the FIGS. since the span no longer needs to be self-supporting. A reduction of the weight of the span is thus obtained.

Figure 9:
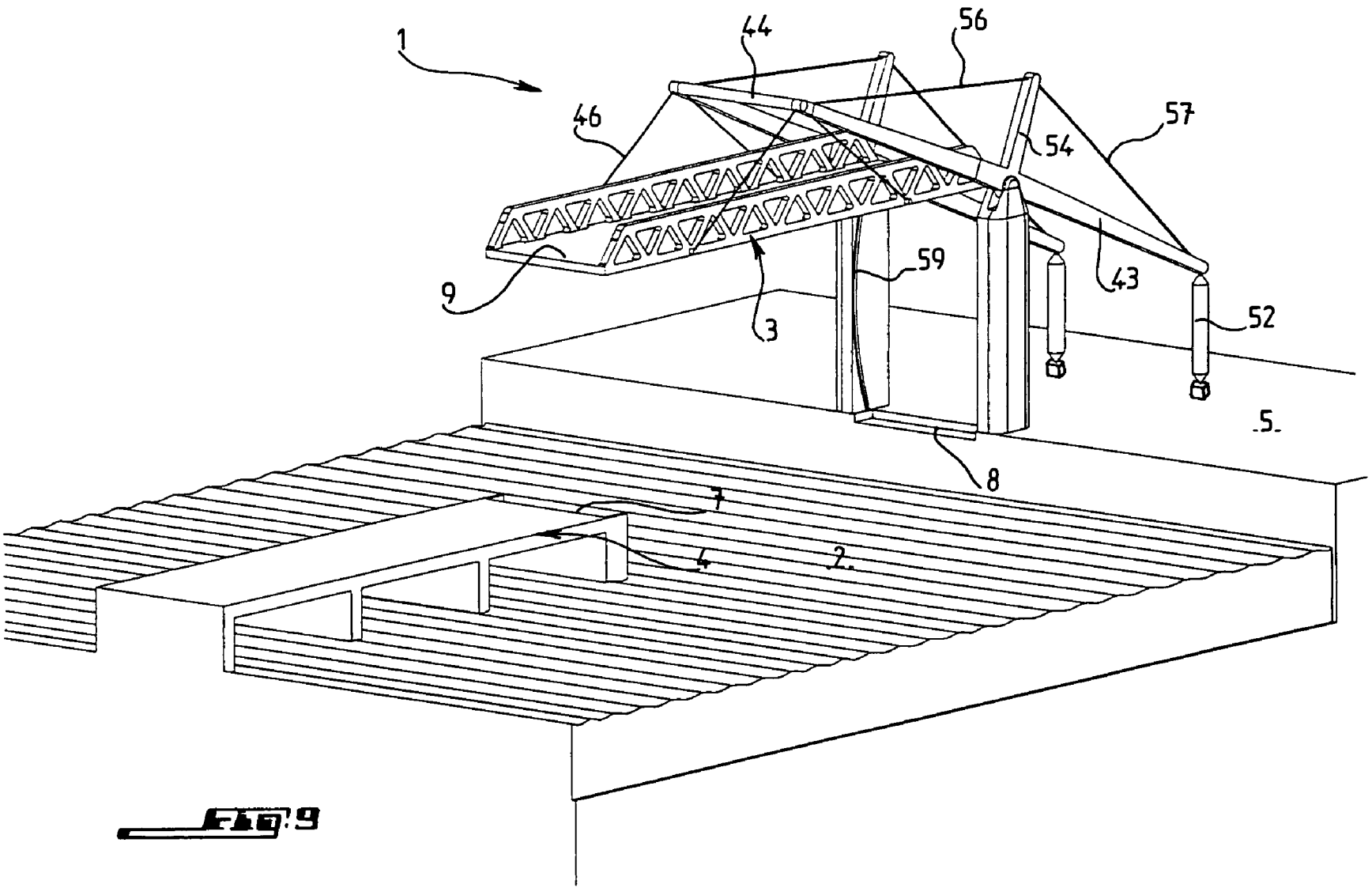
FIG. 9 is a perspective view of the bridge according to FIGS. 7 and 8 but shows the bridge in its high position for opening the channel.
Figure 14:
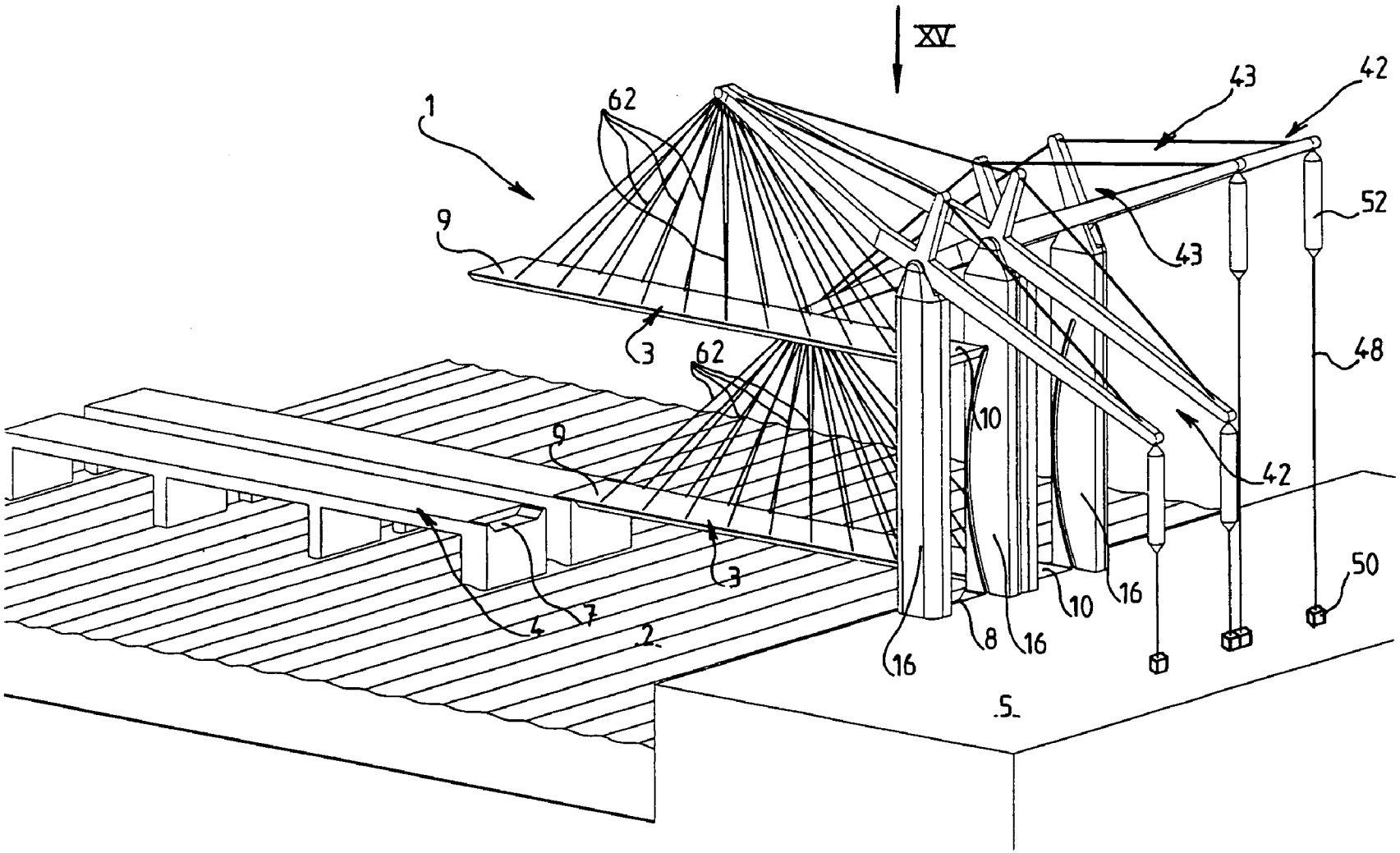
FIG. 14 is a perspective view of a version of the second embodiment of a bridge according to the invention, which has two mobile spans, one of which is represented in its position for crossing the channel and the other of which is represented in its high position for opening the channel.
Figure 15:
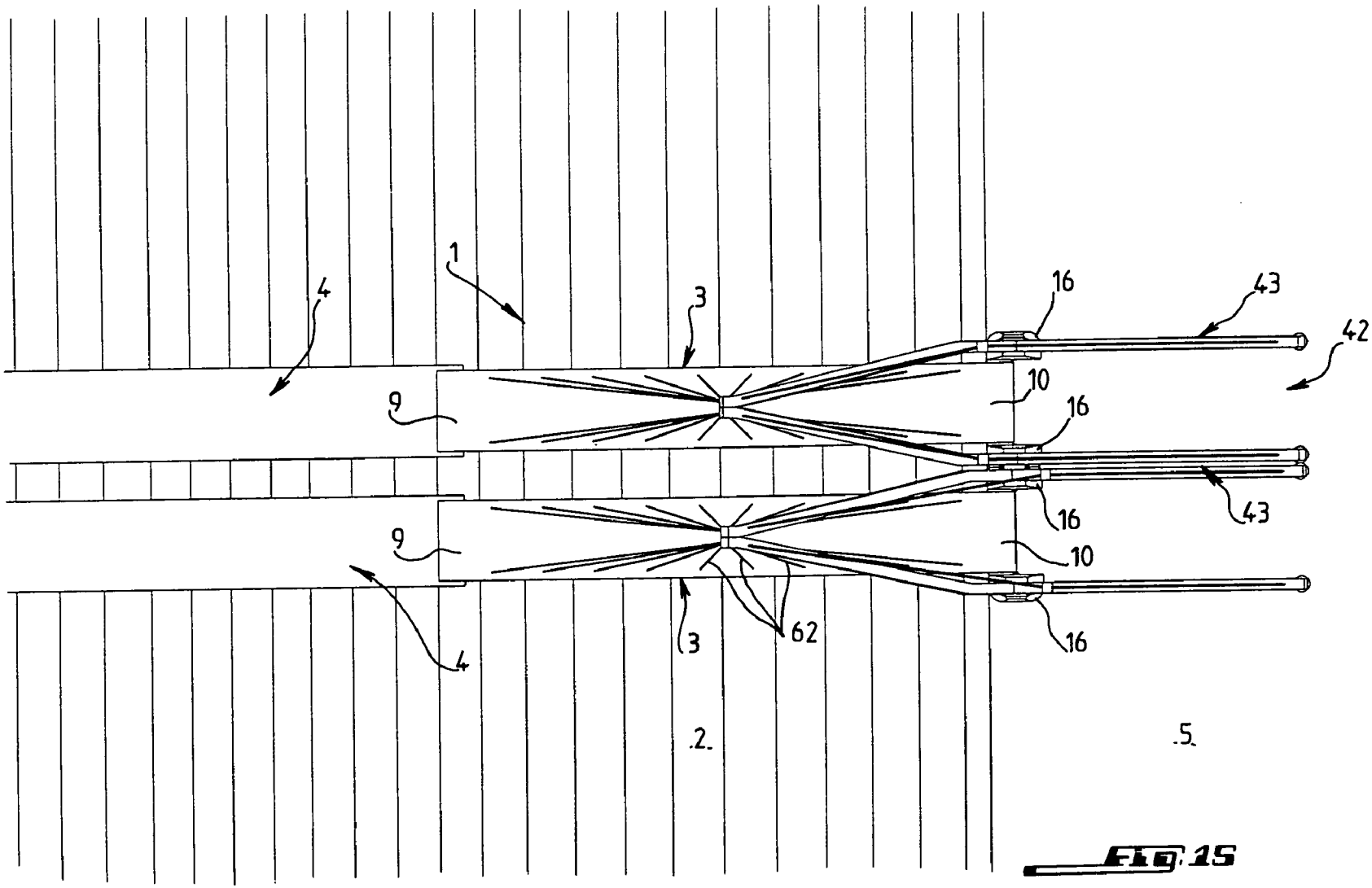
FIG. 15 is a top view of the bridge according to FIG. 14, but where the two spans occupy their position for crossing the channel.

As illustrated by FIG. 14, this implementation version of the span in the form of a cable-stayed span can also be applied to a bridge with two spans, according to FIG. 9.

Figure 16:
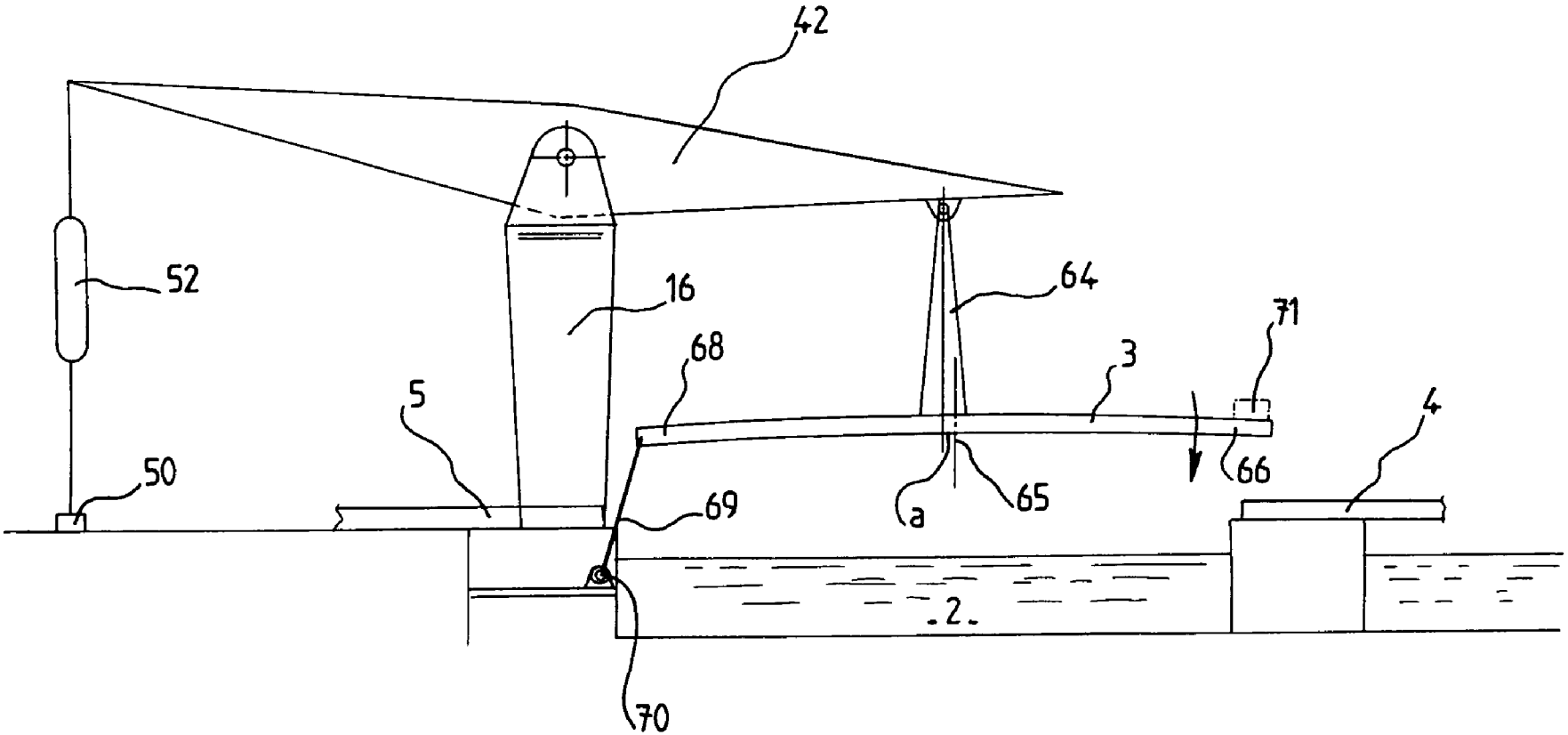
FIG. 16 is a diagrammatic side view of yet another embodiment of the invention.

Another very advantageous embodiment is represented in FIG. 16. In this embodiment, the span is suspended from balance arm 42 by the intermediary of the suspension device indicated by 64 not at its center of gravity symbolized by arrow 65, but rather from a site offset from center 65 in the direction of pylons 16, so that when the span is lifted, it has a tendency to tilt in the direction of arrow 66. The amplitude of this offsetting identified in the figure by the letter "a" is determined as a function of the maximum wind effects that can possibly act on the system, Rotation thus brought about by the span, when it is lifted, in the direction of arrow 66, is prevented by pulling the span downward on its end on the pylon side 68 by means of a pair of cables 69 each of which can be wound on winch 70 or unwound from the winch. Each winch 70 arranged at the foot of pylon 16 unwinds its cable as the lifting of the span progresses in order to follow its position and to ensure its stability regardless of the wind conditions. During the lifting, the span is thus stabilized in all directions both by its suspension from the balance arm and by the follower cable that regulates the rotation of the suspension/span assembly under the balance arm while preventing any untimely pendular motion. For this purpose, the unwinding or winding movements of winches 50 are under the control of the tilting of the balance arm.

It should be noted that the tilting in the direction of arrow 66 could also be occasioned by a weight added at the end of the span away from the pylons, as diagrammatically indicated at 71. This version has the advantage that the suspension of the span can take place at its center of gravity.

Of course, multiple modifications can be made to the bridge as represented in the figures. Thus, the support structures can be designed differently, while taking care that the constitutive elements of these structures are preferably acted upon by traction or compression. The counterweights could be placed differently, integrated or not in the support structures, for example, integrated in the balance arms. In this way also, any type of arrangement for the sheets of stay cables and particularly their number can be considered.

It should be noted that the invention allows the execution of bridges with very long spans whose length can possible reach 100 m or more.

The invention claimed is:

1. A bridge for crossing a channel of a waterway comprising:

stationary supports;

a span which can be moved by vertical translation between a low position for crossing the channel and in which the span rests on the stationary supports of the bridge, and a high position for opening the channel; and a support structure supporting the span, located on a single side of the channel, and comprising lifting means for lifting the span by traction.

2. The bridge according to claim 1, wherein the support structure includes pulleys and the lifting means includes traction cables having first ends attached to the span and second ends connected to a traction device, and running over the pulleys.

3. The bridge for crossing a channel of a waterway comprising:

a span which can be moved by vertical translation between a low position for crossing the channel and in which the span rests on stationary support parts of the bridge, and a high position for opening the channel;

a support structure supporting the span and located on a single side of the channel, the support structure including pulleys; and lifting means for lifting the span by traction and including two traction cables having first ends attached to respective sides of the span and second ends connected to a traction device, the two traction cables running over the pulleys of the support structure in a vertical plane passing through the middle of the span.

4. The bridge according to claim 3, wherein the support structure includes two pylons and primary girders supported by the pylons, each primary girder including at a free end one of the pulleys over which the cables for lifting the span run.

5. The bridge according to claim 4, wherein the pylons and primary girders include reinforcement elements selected from the group consisting of secondary girders and stay cables.

6. A bridge comprising:

a span which can be moved by vertical translation between a low position for crossing the channel and it which the span rests on stationary support parts of the bridge, and a high position for opening the channel;

a support structure supporting the span and located on a single side of the channel;

lifting means for lifting the span by traction, the lifting means including a balance arm pivotally mounted on the support structure and having a first end from which the span is suspended, and pivoting actuation means connected at a second end of the balance arm.

7. The bridge according to claim 6, wherein the span is a self-supporting structure suspended from the first end of the balance arm by suspension cables.

8. The bridge according to claim 6, wherein the span has a lightened structure, borne by multiple stay cables, in the low position and in the high position, the stay cables being suspended from the first end of the balance arm.

9. The bridge according to claim 6, wherein the balance arm includes two levers having two arms pivotally mounted on the pylons.

10. The bridge according to claim 1, including counterweights partially balancing weight of the span.

11. The bridge according to claim 6, including means for stabilization of the span when the span is lifted.

12. The bridge according to claim 11, wherein the means for stabilization includes a guide for an end of the span on a pylon side, guiding the end during lifting of the span.

13. The bridge according to claim 11, including means for tilting the span so that an end of the span spaced from the pylons moves downward, and including cables attached at the end of the span on the pylon side, each of which can be wound on a winch or unwound from the winch to prevent the tilting of the span.

14. The bridge according to claim 13, wherein unwinding and winding movements of the cables from the winch are controlled by tilting of the balance arm.

15. The bridge according to claim 13, wherein the means for tilting includes an offset application to the span of suspension from the balance arm by a distance toward the pylons.

16. The bridge according to claim 13, comprising means for tilting the balance arm including a weight added to an end of the span spaced from the pylons.

17. A bridge for crossing a waterway, the bridge comprising:

a span movable vertically between a low position for crossing of the waterway on the span and blocking a vessel from passing the bridge, the span resting on stationary support parts of the bridge in the low position, and a high position opening the waterway for passage of the vessel past the bridge;

a support structure for the span located on a single side of the channel;

a balance arm pivotably mounted on the support structure and having opposed first and second ends;

a traction cable extending from the span to the first end of the balance arm, and having a first end attached to the span and a second end extending beyond the second end of the balance arm; and a traction device connected to the second end of the traction cable and moving the span vertically, between the low and high positions, by pulling and releasing of the traction cable.

18. The bridge according to claim 17 wherein the traction device is selected from the group including a winch and a jack.

19. A bridge for crossing a channel of a waterway comprising:

stationary supports;

a span which can be moved by vertical translation between a low position for crossing the channel and in which the span rests on the stationary supports of the bridge, and a high position for opening the channel for navigation on the channel of the waterway, under span, with the span above and spaced from the stationary supports;

a support structure supporting the span and located on a single side of the channel; and lifting means for lifting the span by traction from the low position to the high position and for lowering the span from the high position to the low position.

* * * * *